United States Patent [19]

Riermann

[11] Patent Number: 4,494,937

[45] Date of Patent: Jan. 22, 1985

[54] PONTOON ATTACHMENT FOR ALL TERRAIN VEHICLE

[76] Inventor: Fred H. Riermann, 20211 Maxwill, Scandia, Minn. 55073

[21] Appl. No.: 465,700

[22] Filed: Feb. 10, 1983

[51] Int. Cl.[3] ..... B63H 1/100

[52] U.S. Cl. ..... 440/11; 440/90; 114/270

[58] Field of Search ..... 114/270, 284; 440/11, 440/12, 90, 100, 91, 92

[56] References Cited

U.S. PATENT DOCUMENTS

| | | | |
|---|---|---|---|
| 2,278,215 | 3/1942 | Poche | 114/270 |
| 3,191,573 | 6/1965 | Hixon | 440/59 |
| 3,709,185 | 1/1973 | Hennel | 440/90 |
| 4,050,399 | 9/1977 | Mochel | 440/12 |

*Primary Examiner*—Galen L. Barefoot
*Assistant Examiner*—Jesûs D. Sotelo
*Attorney, Agent, or Firm*—Jacobson & Johnson

[57] ABSTRACT

A pontoon flotation device attachment for an all terrain vehicle with the pontoon flotation device having a mechanism to raise the pontoons when the all terrain vehicle enters or leaves the water and to lower the pontoons when the all terrain vehicle is in the water. A pair of paddle wheels are mounted to the drive mechanism of the all terrain vehicle to propel the pontoon flotation device in the water. Steering rudders on the pontoon flotation device connect to the steering mechanism of the all terrain vehicle so that the pontoon flotation device can be steered using the steering mechanism of the all terrain vehicle.

9 Claims, 24 Drawing Figures

PONTOON ATTACHMENT FOR ALL TERRAIN VEHICLE

FIELD OF THE INVENTION

This invention relates generally to flotation devices and, more specifically, to flotation devices for attachment to all terrain vehicles.

DESCRIPTION OF THE PRIOR ART

All terrain vehicles for going over land, mud and snow have achieved substantial popularity during the past few years. Typically, the all terrain vehicle is comprised of three or more high flotation wheels, a steering mechanism and a motor for propelling the all terrain vehicle at speeds in excess of forty miles per hour.

BRIEF DESCRIPTION OF THE DRAWINGS

FIG. 2 shows a side view of a rudder for use in my pontoon flotation device.

BRIEF SUMMARY OF THE INVENTION

Figure 1:
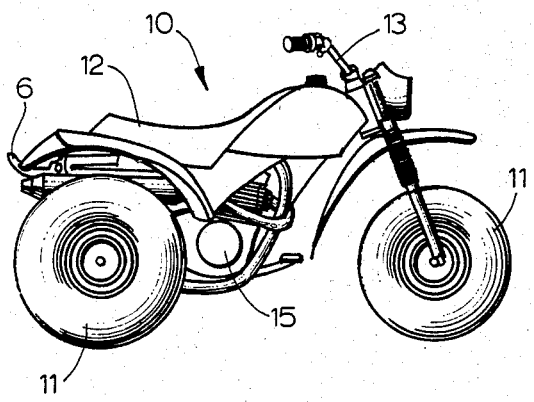
FIG. 1 is a side view of a prior art all terrain vehicle.

Briefly, the invention comprises pontoons for attachment to an all terrain vehicle to permit the all terrain vehicle to be used in the water. A drive mechanism on the pontoons permits raising and lowering of the pontoons so that the all terrain vehicle can be driven into the water with the pontoons raised and then lowered so that the all terrain vehicle is substantially out of the water. A pair of rotatable paddle wheels mounted to the rear drive of the all terrain vehicle permit the all terrain vehicle power source to propel the pontoons and the all terrain vehicle through the water. A set of rudders on the pontoon connected to the steering control of the all terrain vehicle permit the operator to steer and propel the all terrain vehicle as if it were on land.

DESCRIPTION OF THE PREFERRED EMBODIMENT

Referring to FIGS. 1–4 reference numeral 10 generally designates a three wheel all terrain vehicle. Typically, all terrain vehicles have three high flotation tires 11, a seat 12, a steering and control mechanism 13, a motor 15 and a hand hold 6 that attaches to the frame of all terrain vehicle 10.

Figure 2:
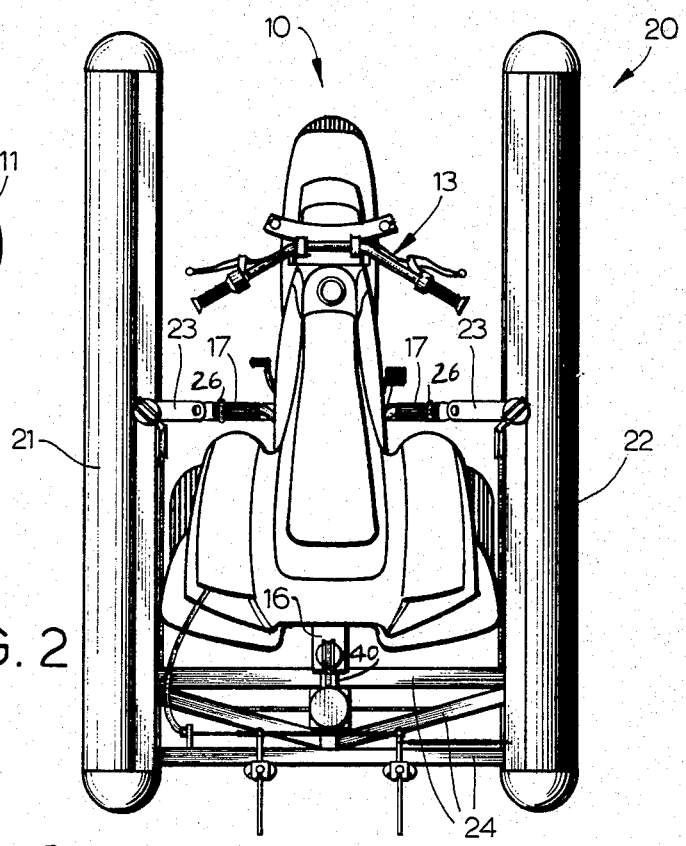
FIG. 2 is a top view of an all terrain vehicle mounted on a pontoon flotation device.

FIG. 2 shows a top view of an all terrain vehicle 10 mounted on my pontoon flotation device 20 which comprises a first flotation pontoon 21 and a second flotation pontoon 22. Pontoon 21 and pontoon 22 are in a spaced parallel position and connected to each other at the rear of each of the pontoons by a rear tubular support structure 24. Rear tubular support structure includes a rear support 40 which connects to a trailer hitch 16 located on the rear of all terrain vehicle 10. Located about in the middle of pontoon 21 is a left side support 23 which fastens to cross bar support attached to a left foot rest 17 on all terrain vehicle 10. Similarly, a right support 23 mounts to middle of pontoon 22 and fastens to a cross bar support attached to right foot rest 17 on all terrain vehicle 10. It is left side support 23 and right side support 23 and rear support 40 on pontoon flotation device 20 which provides a three point support attachment for mounting all terrain vehicle 10 between pontoons 21 and 22. The pontoons 21 and 22 are typically made from welded aluminum tanks although other types of flotation devices could also be used.

Figure 3:
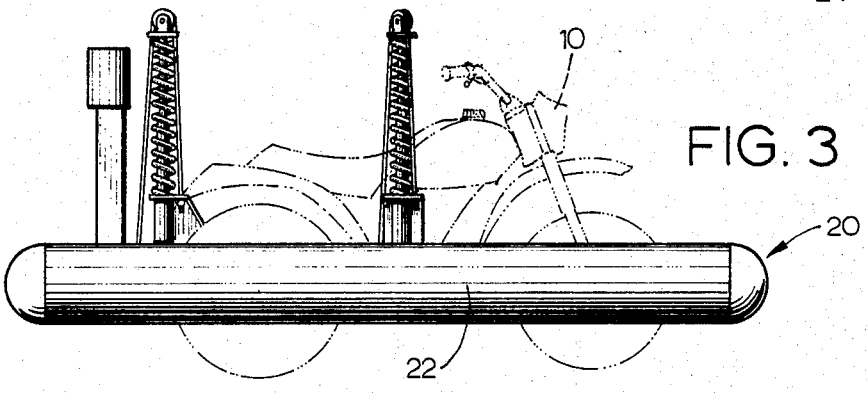
FIG. 3 is a side view of the pontoon flotation device and an all terrain vehicle.
Figure 4:
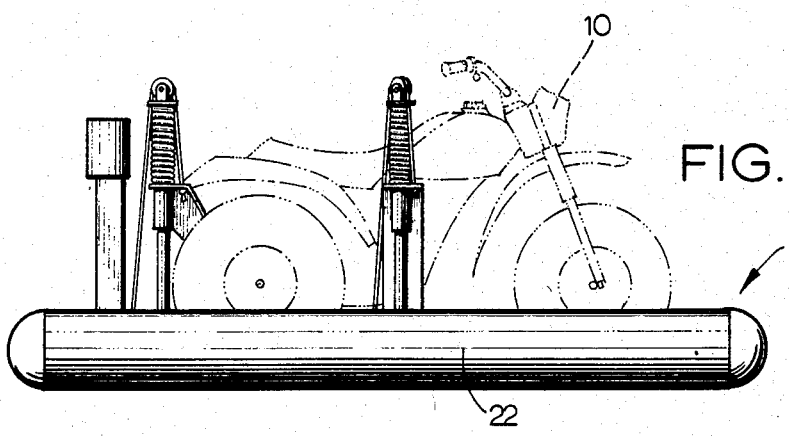
FIG. 4 is an identical view to FIG. 3 except the pontoon flotation device has been lowered for use in water.

FIGS. 3 and 4 illustrate that pontoon flotation device 20 can be lowered or raised with respect to all terrain vehicle 10. That is, FIG. 3 shows pontoon flotation device 20 in the upper or raised position. In the raised position all terrain vehicle 10 and pontoon flotation device 20 can be driven into the water under the power of the all terrain vehicle. FIG. 4 shows pontoon flotation device 20 in the lowered position. In the lowered position all terrain vehicle 10 sits sufficiently high with respect to the water level so that only the lower portions of the flotation tires 11 are in the water. That is, when viewed in FIG. 4 the water line would be $\frac{2}{3}$ to $\frac{3}{4}$ covering pontoon 22. When using the all terrain vehicle in water one would normally maintain the all terrain vehicle 10 in the position shown in FIG. 4.

Figure 5:
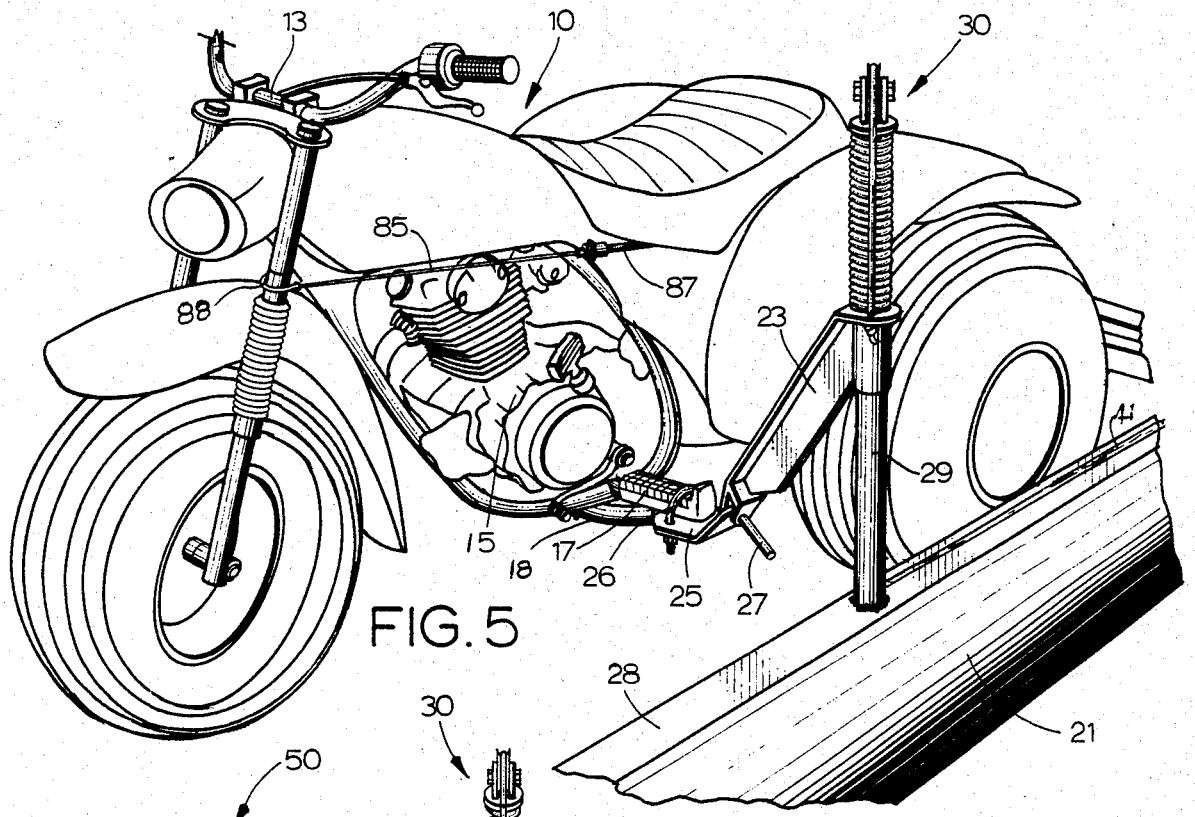
FIG. 5 is a side view showing the attachment of the pontoon flotation device to the all terrain vehicle.

FIG. 5 shows details of how left side support 23 is mounted to all terrain vehicle 10 and pontoon 21. Located beneath all terrain vehicle is a cross bar 18 having a plate 25 that attaches to left foot rest 17 by a U bolt 26 and to right foot rest 17 by a U bolt 26 (FIG. 2). Plate 25 is located on each end of cross bar 18 and has an opening that mates with the cleviced end of support 23 through a pin 27 which is inserted through the opening in plate 25 and the cleviced end of support 23. The other end of support 23 has a collar that slidingly fits over a cylindrical post 29 that extends vertically upward from an angle bar 28 mounted on pontoon 21. Similarly, located on the right side of all terrain vehicle 10 is an identical mechanism for attaching pontoon 22 to right foot rest 17 (FIG. 2). However, since the mechanism on the opposite side is identical to that shown in FIG. 5 no details are shown.

Figure 7:
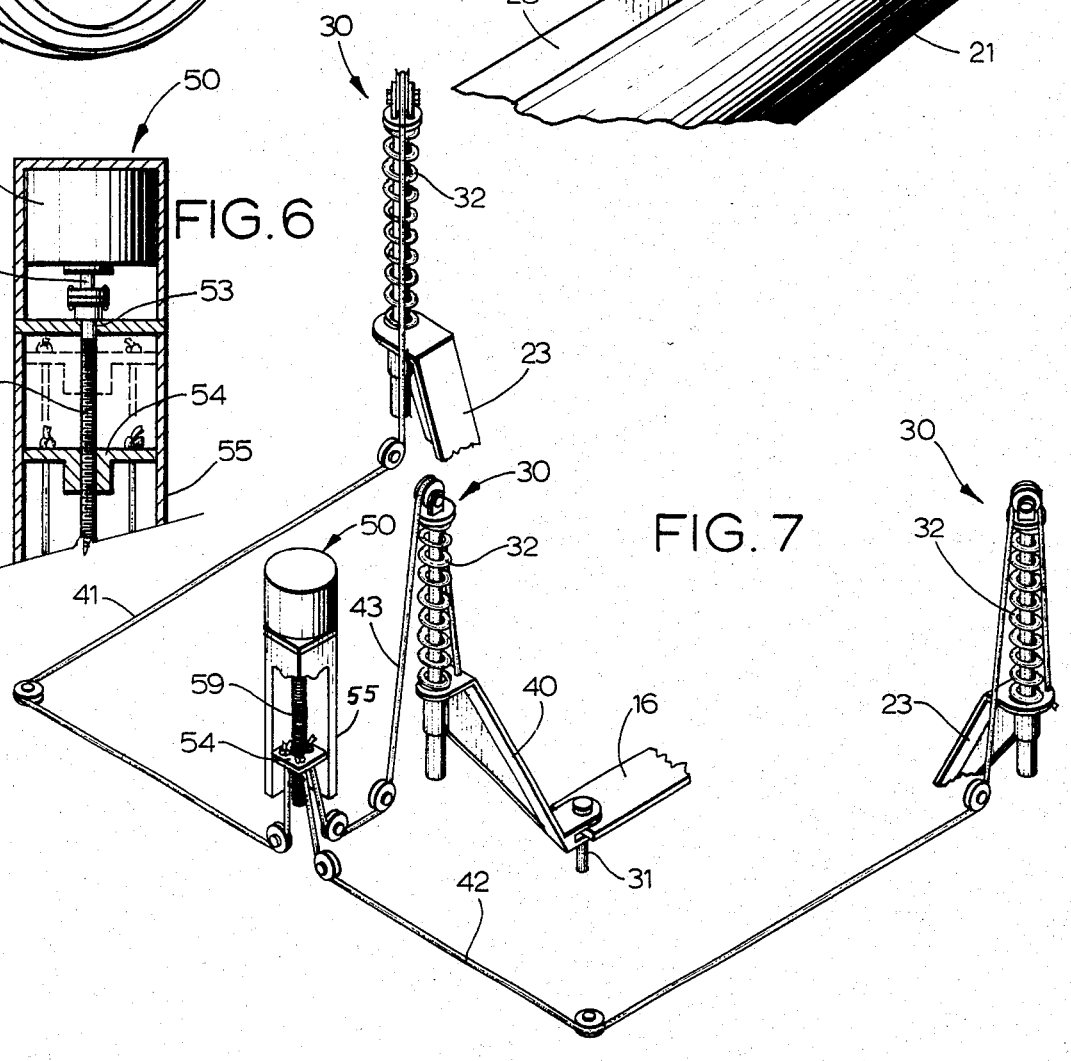
FIG. 7 shows a detail of the pulley and cable mechanism for raising and lowering pontoon flotation device.

Located on cylindrical post 29 is a spring and a pulley mechanism 30 for raising and lowering pontoon flotation device 20 with respect to all terrain vehicle 10. Reference to FIG. 7 shows the details of three identical spring and pulley mechanisms 30 which operate in unison for raising and lowering pontoon flotation device 20 with respect to all terrain vehicle 10. To illustrate the raising and lowering of the pontoon flotation device 20 it should be noted that spring and pulley mechanisms 30 are identical to each other and that the three cables 41, 42 and 43 extend from the spring and pulley mechanisms 30 to a plate 54 located in housing 55. FIG. 7 also illustrates portions of the two side attachment supports 23 and the rear attachments support 40 on pontoon attachment device 20. Note, rear attachment support 40 attaches to all terrain trailer hitch 16 through a pin 31. All three pulleys and spring mechanisms 30 are identical in operation and permit one to raise pontoon flotation device 20 when cables 41, 42 and 43 are pulled upward by plate 54. That is, one end of cable 41 fastens to left support 23 and the other end to plate 54 and one end of cable 42 fastens to right support 23 and the other end fastens to plate 54 so that pulling on cables 41 and 42 compresses spring 32 on side supports 23 to raise both left and right supports 23. Similarly, one end of cable 43 fastens to rear support 40 and the other to plate 54 so that pulling on cable 43 compresses spring 32 on rear support 50 to raise rear support 40. To provide the necessary force to raise or lower plate 54 there is provided a power drive screw mechanism comprising a threaded member 59 which engages a threaded opening in plate 54 so that rotation of threaded member 59 in one direction raises plate 54 and in the opposite direction lowers plate 54. Threaded member 54 can be either motor or hand powered although motor powered is preferred.

Figure 6:
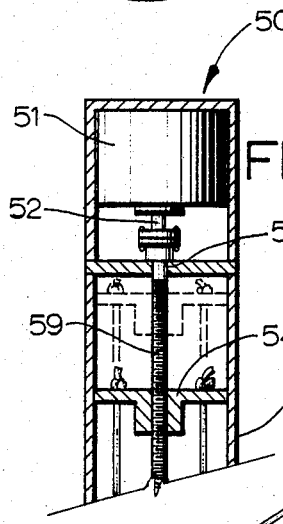
FIG. 6 shows a detail of a screw drive mechanism for raising or lowering the pontoon flotation device.

FIG. 6 shows in greater detail the drive screw lifting mechanism using a reversible DC motor to raise and lower plate 54. Drive screw lifting mechanism comprises a housing 55, a high torque, low RPM reversible DC electric motor 51, a shaft 52 coupled to the threaded member 59 with threaded member 59 rotatably mounted in an opening 53 in housing 55. Plate 54 which is vertically slidable within housing 55 contains a female threaded member which engages threaded member 59. Although plate 54 is vertically slidable, it is prevented from rotating in housing 55 by the square shaped housing 55. That is, as shaft 52 turns plate 54 cannot rotate so it must move up or down on treaded member 59 thus causing plate 54 to be either raised or lowered depending on the direction of rotation of threaded member 59. As plate 54 is raised it pulls on cables 41, 42 and 43 which compress springs 32 as it raises supports 23 and 40 to thereby raise pontoon flotation device 20 with respect to all terrain vehicle 10. Although a reversible DC motor 51, which can be powered from the battery of the all terrain vehicle, is used to raise and lower the pontoon flotation device, a hand crank could be used to rotate threaded member 59 if manual raising and lowering is desired.

Figure 8A:
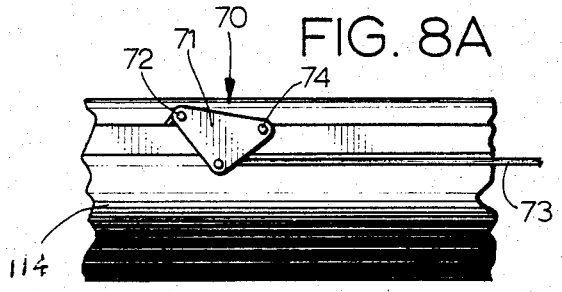
FIG. 8A shows a pivot plate pontoon lifting mechanism in the lowered position.
Figure 8B:
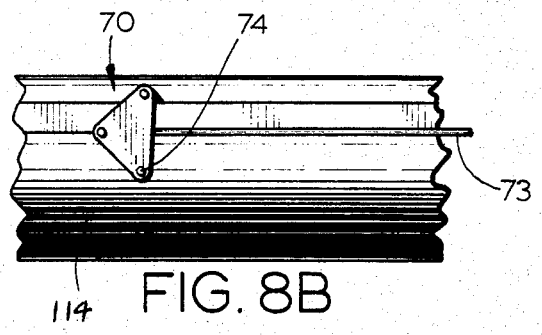
FIG. 8B shows the pivot plate pontoon lifting mechanism of FIG. 8A in the raised position.

Referring to FIGS. 8A and 8B the pivot plates of the preferred lifting mechanism are shown comprising a pivotal bracket assembly 70 which replaces spring and pulley mechanism 30 shown in FIG. 7. A bracket 71 is pivotally mounted about a pivot pin 72 extending from pontoon 114. A member 74 extends outward from plate 71 for connection to foot rest 17 on all terrain vehicle 10. FIG. 8A shows bracket assembly 70 in the lateral position which corresponds to lowered pontoons (FIG. 4) while FIG. 8B shows bracket assembly 70 in the vertical position which corresponds to the raised pontoon position (FIG. 3). Note, the change in elevation of member 74 produced by partial rotation of bracket 71. To rotate bracket assembly 70 there is provided a control rod 73 which connects to a drive mechanism that pushes or pulls on control rod 73 to thereby rotate pivot plate 71.

Figure 9:
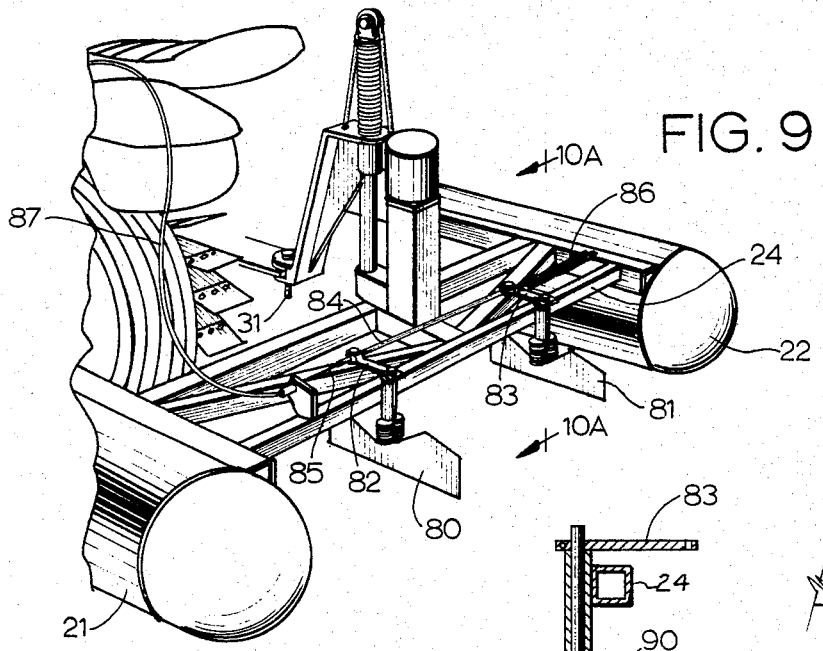
FIG. 9 is a partial rear view of the pontoon flotation device.
Figure 10A:
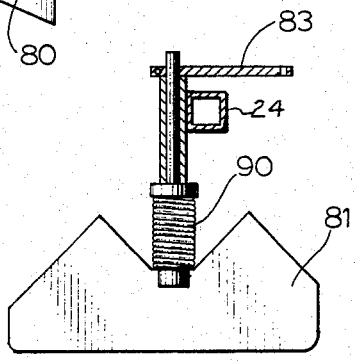
FIG. 10A is a side view illustrating the details of a steering rudder.
Figure 10B:
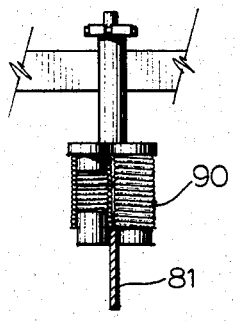
FIG. 10B is a rear view illustrating the details of a steering rudder.
Figure 11:
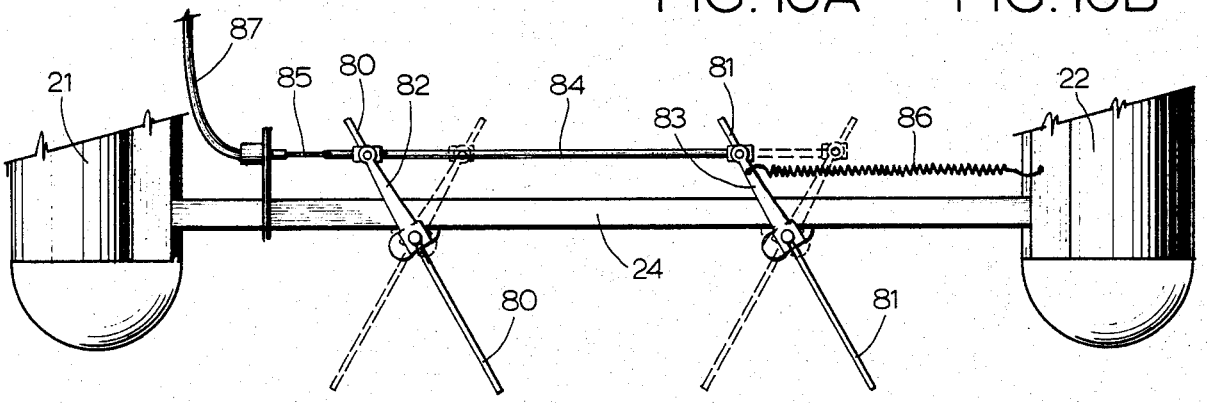
FIG. 11 shows the rudder steering mechanism on the pontoon flotation device.

FIGS. 9–11 show the details of the steering mechanism which comprise a pair of rudders 80 and 81 which are pivotally mounted on cross support 24. Rudder 80 has a vertical shaft and horizontal turning arm 82 and rudder 81 has a vertical shaft and horizontal turning arm 83 which connect to a laterally displaceable tie rod 84. One end of the tie rod 84 is restrained from lateral displacement by a spring 85 and the opposite end of the tie rod 84 connects to a steering cable 85. Located on rudders 81 and 80 are spring shock mounts (FIG. 10A and FIG. 10B) which comprise a set of springs 90 that connect vertical shaft and horizontal turning arm to tie rod 84 so that rudders 80 and 81 can rotate and flex to absorb torsion shocks should the rudders hit an obstruction.

FIG. 11 illustrates how one can steer pontoon flotation device 20 by turning rudders 80 and 81 by merely pulling or releasing steering cable 85. Steering cable 85 which extends into and through a cable housing 87 that extends generally along and under the seat of all terrain vehicle 10. One end of cable housing 87 attaches to all terrain vehicle 10 and the other end of cable housing attaches to cross support 24 (FIG. 11). FIG. 5 shows steering cable 85 extends through cable housing 87 and attaches to front fork of steering mechanism 13 through a U-shaped hook 88 so that when one turns steering mechanism 13 it will correspondingly displace cable 85 thereby turning rudders 80 and 81. Thus, the steering controls for driving all terrain vehicle 10 in water and on land are the same since turning the front wheel also turns rudders 80 and 81 through corrsponding lateral displacement of cable 85. A further advantage is that the steering cable can quickly be attached or detached.

Figure 12:
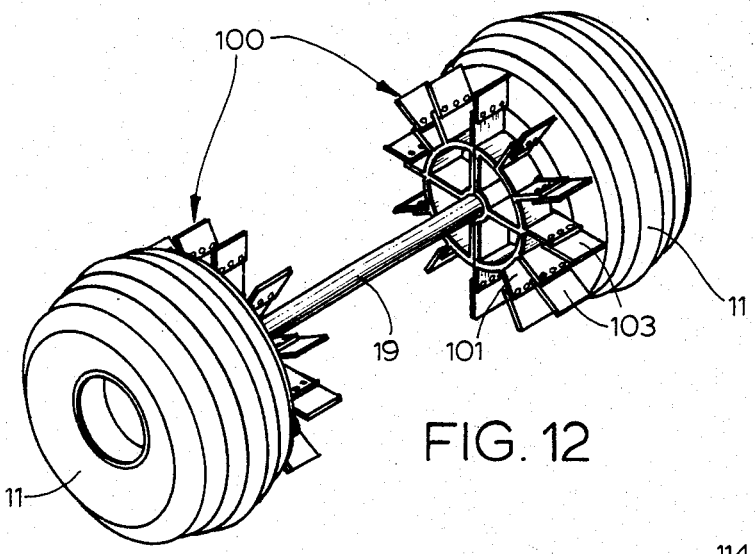
FIG. 12 shows paddle wheels for powering the pontoon flotation device.
Figure 13:
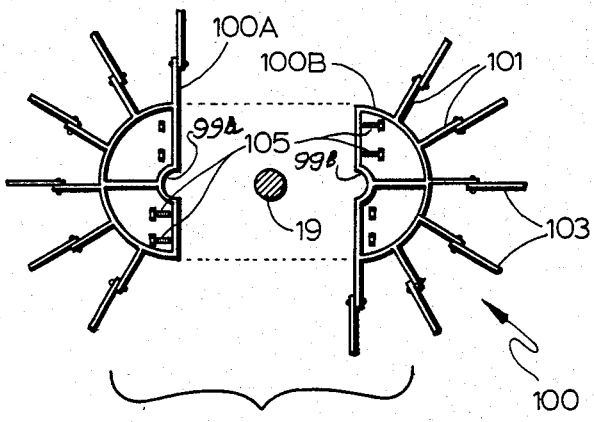
FIG. 13 shows an exploded view of the paddle wheel attachment device.

In order to provide water propulsion from the power unit 15 on all terrain vehicle 10 I provide a pair of paddle wheel attachments which are clamped to rear drive shaft 19 of all terrain vehicle 10 (FIG. 12). Located on each end of shaft 19 and adjacent tire 11 is a paddle wheel 100. FIG. 13 shows an exploded view of paddle wheel 100 comprising a pair of semicircular housings 100A and 100B with a set of rigid radial paddle fins 101 having flexible vanes 103 connected thereto. FIG. 13 also shows that paddle wheel halves 100A and 100B can be separated into two parts so that semicircular recess 99A and semicircular recess 99B can be clamped around shaft 19 by a set of fasteners 105. Fasteners 105 are typically nuts and bolts which permit paddle attachment housings 100A and 100B to be clamped securely to drive shaft 19 so that rotation of shaft 19 correspondingly rotates paddle wheels 100 to thereby propel my pontoon flotation device and the all terrain vehicle 10 through the water. The flexible vanes 103 on the end of paddle fins 101 provide for flexibility to prevent damage to the ends of vane 103 should the vanes hit an obstruction when travelling over land. That is, since paddle wheels 100 are designed for semi-permanent mounting vanes 103 are flexible to permit vanes 103 to bend should the all terrain vehicle hit an obstruction going in or out of the water.

Figure 16:
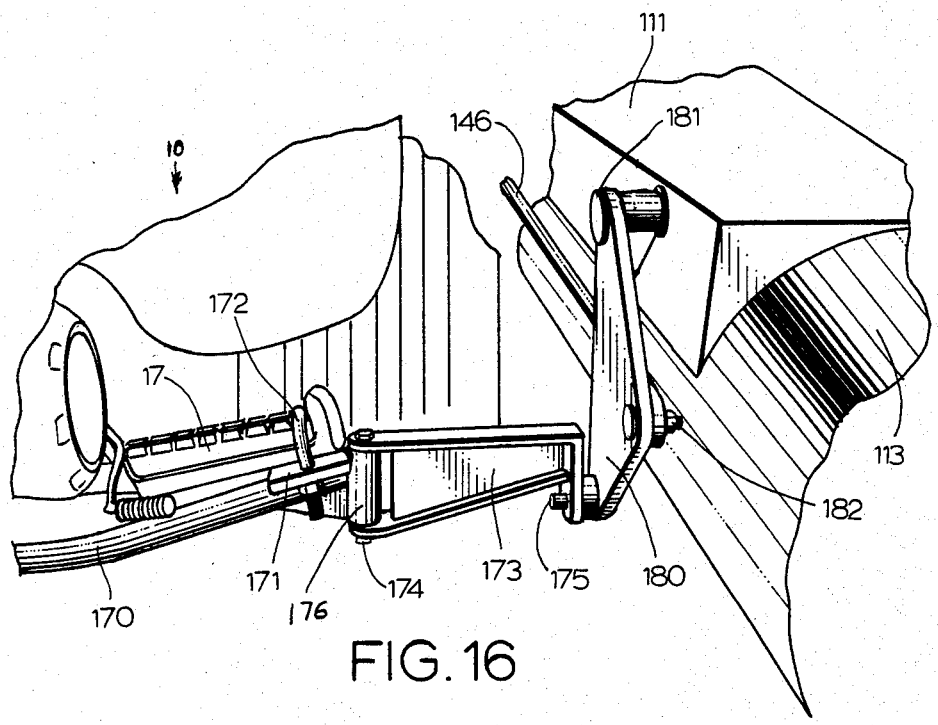
FIG. 16 is a front view of a side attachment mechanism.

Referring to FIGS. 16–20 there is shown the details of a pontoon flotation device 110 which uses the pivotal bracket system illustrated in FIGS. 8A and 8B to raise and lower a pair of flotation pontoons. FIG. 16 shows the details of the mechanism for mounting left foot rest 17 to pontoon flotation device 110. That is, located under left foot rest 17 is a cross member 170 that extends underneath all terrain vehicle 10 to the opposite right foot rest 17. On one end of member 170 is a plate 171 that mounts to left foot rest 17 through a U bolt 172. Plate 171 includes a cylindrical housing 176 having a cylindrical opening therein for insertion of a pivot pin 174 therethrough. FIG. 16 shows that the Y-shaped end of a link 173 fits over the housing 176 and pivotally fastens to housing 176 through a pivot pin 174. The other end of link 173 pivotally fastens to pivot plate 180 through a pivot pin 175. Typically, pivot pin 175 extends through an opening in the lower portion of triangular pivot plate 180 and is held in place by a cotter key or the like. A pivot pin 175 pivotally connects a control rod 146 to the centermost point of triangular pivot plate 180. Pivot plate 180 is pivotable about a pivot pin 181 that is mounted in housing 111 which extends from the top surface of pontoon 113 in the same manner that pivot plate 71 is pivotal about pivot pin 72 (FIG. 8A and FIG. 8B). Since the left side attachment mechanism shown in FIG. 16 is identical to the right side attachment mechanism, only one is described herein. It will be noted that there are two pivotal attachment points on link 173 a vertical pivot pin 174 and a horizontal pivot pin 175. These two pivotal attachments permit rapid detachment of link 173 so that all terrain vehicle can be detached and quickly driven away from the pontoons. That is, by removing pin 175, link 173 can be swung forward to permit the all terrain vehicle to be driven away from the pontoons.

Figure 20:
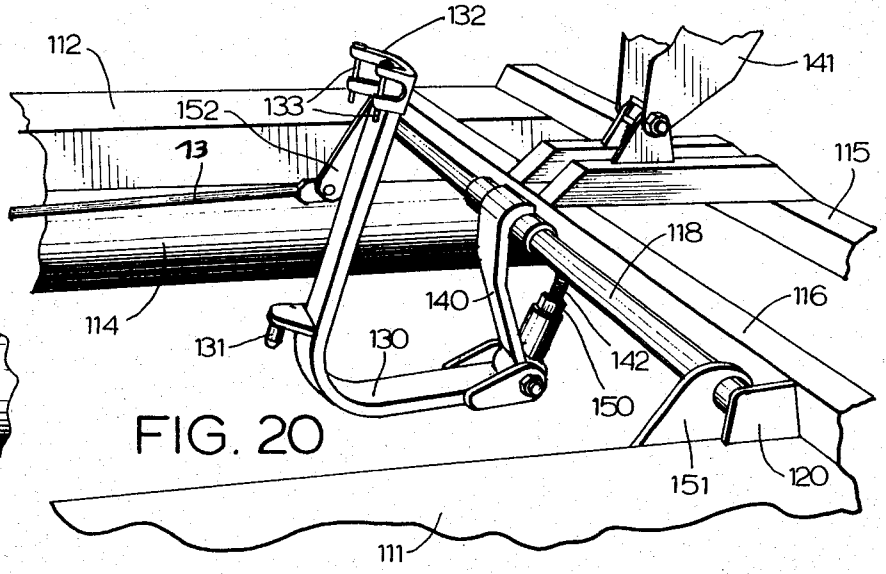
FIG. 20 is a detailed view of the linkage that connects the rear of the all terrain vehicle to the pontoon flotation device.
Figure 17:
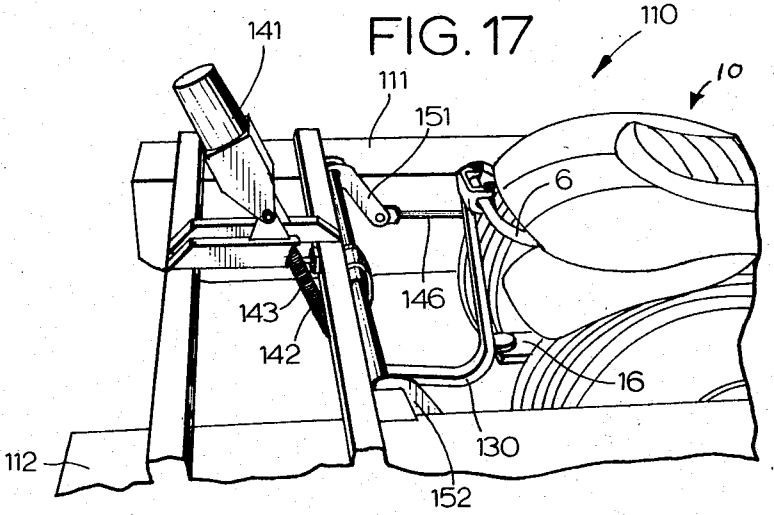
FIG. 17 shows the preferred embodiment of a pontoon lifting system mounted on an all terrain vehicle.

Referring to FIGS. 17–20 there is shown the rear lifting mechanism of a pontoon flotation device 110 which is attached to all terrain vehicle support 6 and trailer hitch 16. FIG. 17 shows a generally L-shaped tongue 130 that connects to trailer hitch 16 and support 6. FIG. 20 shows the details of tongue 130 comprising a pair of U-shaped yoke members 132 which fit around support member 6. A pair of removable pins 133 hold yoke members 132 on support 6. Located on the lower portion of tongue 130 is a pin 131 that is integrally fastened to tongue 130. When yoke member 132 is fastened to support 6 pin 131 extends through the opening in hitch 16 and is held in place by the coaction of yoke member 132 and support 6. Located in pivotal connection with the lower end of tongue 130 is a member 140 that extends upward and fastens to a cylindrical rod 118 which is held in rotational support by a housing 119 and a housing 120. Connected to the pivotal junction of members 140 and tongue 130 is a threaded housing 150 and a threaded shaft 142 which extends upward into a screw drive mechanism 141. That is, screw drive mechanism 141 is similar to the screw drive mechanism in housing 50 (FIG. 6) which contains a reversible electric motor therein. Screw drive mechanism 141 similarly contains means for turning threaded shaft 142 in either a clockwise or counterclockwise direction. Rotating member 142 in a first direction pulls pontoons on the rear support structure closer to the junction of tongue 130 and member 140 thus lowering the pontoons with respect to all terrain vehicle 10. Similarly, rotating threaded member 142 in the opposite direction raises the pontoons and rear support structure with respect to the junction of member 140 and tongue 130 thus raising the pontoons with respect to all terrain vehicle 10. It will be noted that one end of member 140 integrally connects to rotatable cylindrical rod 118 and that fastened near the ends of cylindrical rod 118 are lever arms 152 and 151. The raising the lowering of the pontoons with respect to the junction of members 140 and tongue 130 will correspondingly rotate member 118 to produce rotational motion of members 151 and 152. The rotation of member 118 causes a corresponding forward or rearward displacement of control rods 73 and 146. The pivoting motion has been previously described with respect to FIGS. 8A and 8B provides for a lifting or lowering of the front portion of the pontoons with respect to the foot rests.

Figure 18:
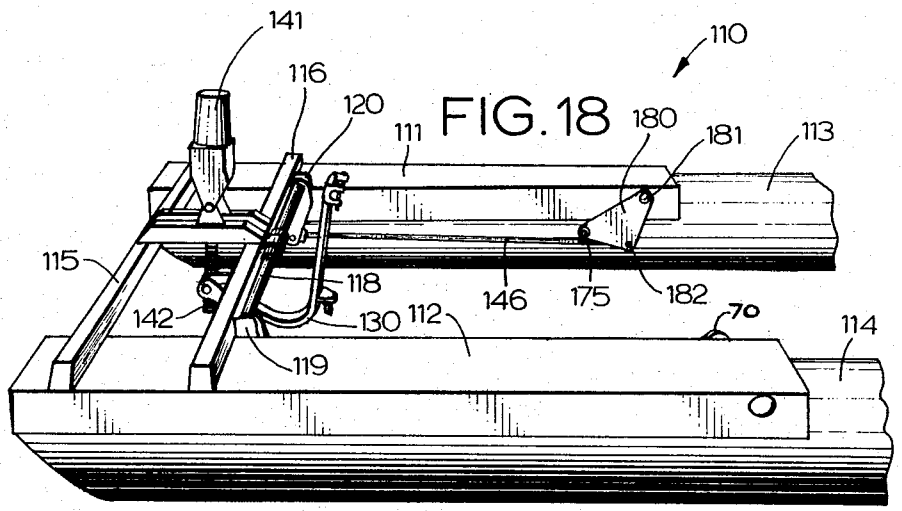
FIG. 18 shows a side view of pontoon lifting mechanism.
Figure 19:
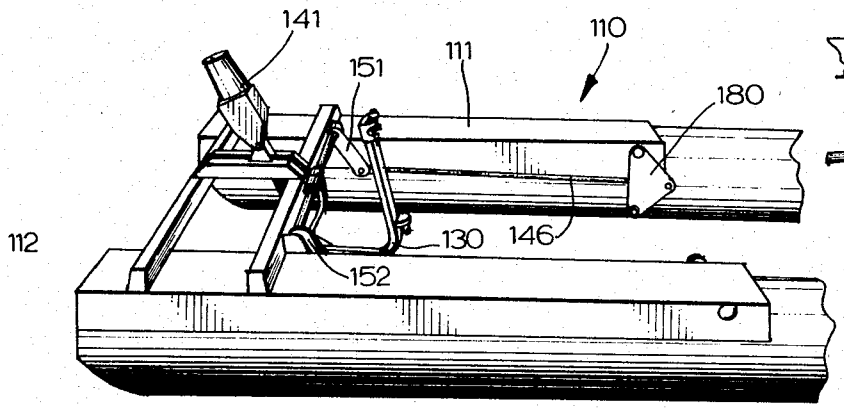
FIG. 19 is further side view of the pontoon lifting mechanism.

FIGS. 18 and 19 illustrate the linkage in various positions without the all terrain vehicle attached thereto. Thus, it will be appreciated that pontoon flotation device 110 can be raised or lowered with respect to an all terrain vehicle through movement of the rear supports 115 and 116 with respect to the pivotal junction of member 140 and tongue 130.

FIG. 17 shows an electrical switch 143 which connects between the power source and the screw drive mechanisms 141 so that when the pontoons have been raised to the proper position a stop (not shown) on bar 120 closes switch 143 to shut off the drive motor in drive mechanism 141. Similarly, a second electrical switch (not shown) provides for turning off the power to motor in housing 141 when the pontoons have been lowered to the proper position.

Figure 14:
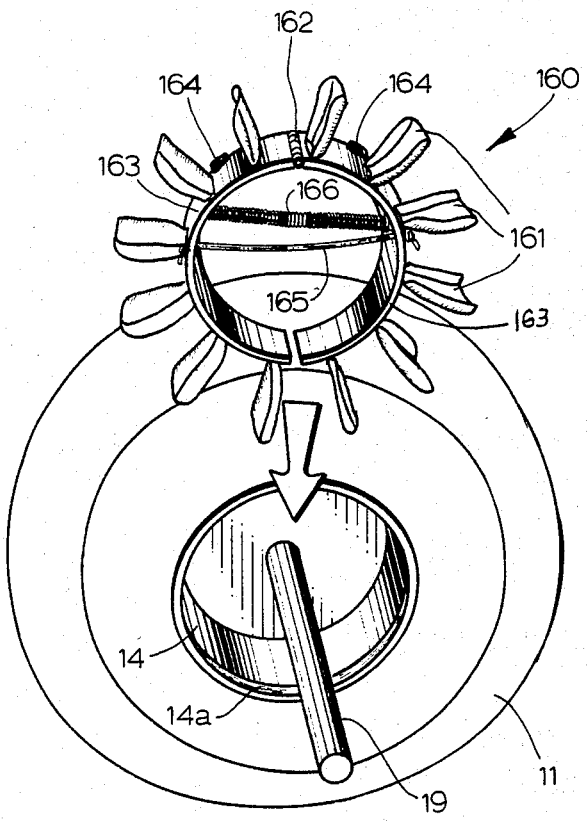
FIG. 14 is a pictorial view of an alternate embodiment of a paddle wheel for quickly mounting the rim of a tire of a three wheel vehicle.
Figure 15:
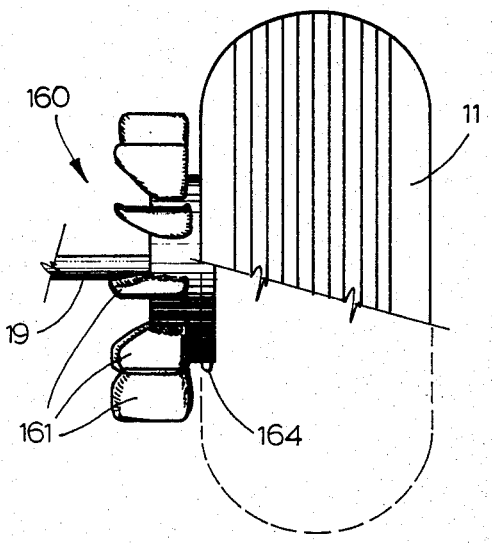
FIG. 15 is a rear view of the paddle wheel of FIG. 14 mounted on the rim of an all terrain vehicle tire.

Referring to FIG. 14 there is shown the preferred embodiment of a quick mount paddle wheel attachment 160 for mounting on the inside of rim 14 of tire 11. A drive shaft 19 extends centrally into rim 14 which has a recess or circular lip 14A therein which is used to mount paddle wheel attachment 160 concentric with drive shaft 19. Quick mount paddle wheel attachment 160 has a set of radially spaced water paddles 161 extending therefrom and two semicircular members 163 which are pivotally joined together by a hinge 162. A compression spring 162 provides an outward force to push pivot members 163 apart from each other while a cable 165 restrains outward motion of members 163. It will be noted that there is a gap between the unhinged ends of members 163 which is sufficient for insertion of paddle wheel 160 around drive shaft 19. Once positioned around drive shaft 19 members 163 are forced together and inserted in rim 14 so that protrusions 164 engage the recess 14A. With protrusions 164 located in rim 14A it prevents axial displacement of paddle wheel 160 with respect to rim 14 while the separating force produced by compression spring 166 provides sufficient external radial force to frictionally hold paddle wheel 160 in rim 14 so that rotation of drive shaft 19 and rim 14 drives paddle wheel 160 through the water. It will be envisioned that an identical quick mount paddle wheel can be mounted on the opposite rim and that both can be quickly attached or detached from a rim on the opposite rear wheel of the all terrain vehicle.

Figure 21:
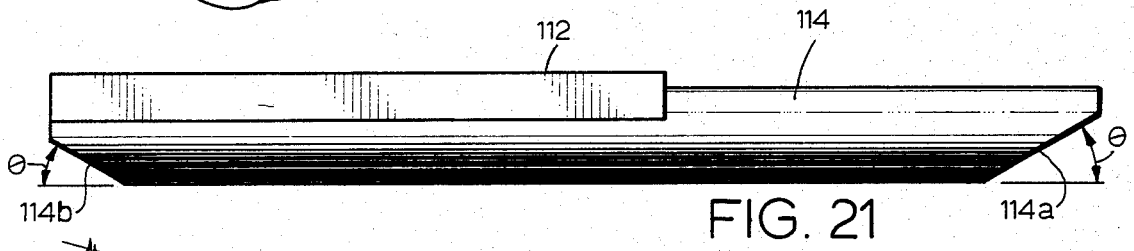
FIG. 21 shows a side view of a pontoon for use in my pontoon flotation device.
Figure 22:
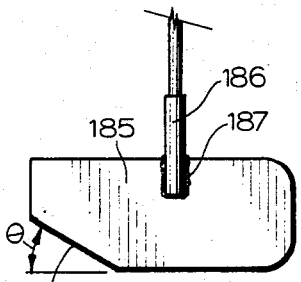

Referring to FIG. 21 there is shown a full length view of pontoon 114 having a housing 112. Pontoon 114 has a beveled front end 114A and a beveled rear end 114B. Similarly, FIG. 22 shows a rudder 185 which has a vertical rod 186 which is welded to rudder 185 by a weld 187. Rudder 185 has a beveled rear end 189. It will be envisioned that the angle $\theta$ on the front and back and on rudders 185 is at an angle so as to provide greater pontoon clearance when entering and leaving the water when pontoons attached vehicle 10. That is, by making the rear pontoons as well as the rudder which can project out to ends of the pontoons at an angle of approximately 30° one provides for less opportunity for hang up of the pontoons as one enters or leaves the water.

A further feature of the lifting mechanism 141 is that when the threaded member 142 pulls the rear structure and drive mechanism 141 toward the junction of tongue 130 and member 140 it moves the pontoons forward since member 140 must pivot about its junction with tongue 130 which is mounted to the hitch on the all terrain vehicle. The forward displacement of the pontoon flotation device when the pontoons are lowered has been found to be beneficial in that for operational balance it is preferred to have the pontoons slightly more forward than when one wishes to enter or leave the water. That is, when the pontoons are raised with respect to the all terrain vehicle, the pivoting about the junction of 130 and member 140 automatically moves the pontoon slightly rearward with respect to all terrain vehicle 10. If the pontoons are moved rearward it is easier to drive the all terrain vehicle with the pontoon attachment device in and out of the water without hanging up the pontoons on the shore, i.e., the less the pontoons protrude from the front of the all terrain vehicle the greater forward ground clearance.

I claim:

1. A flotation device for an all terrain vehicle having a sterring mechanism, a drive mechanism, foot rests and rear support structure comprising:

flotation means for supporting the all terrain vehicle in water, said flotation means comprising a first pontoon and a second pontoon;

first attachment means connected to said first pontoon and said second pontoon, said first attachment means operable to hold said first pontoon and said second pontoon in a spaced condition and for attachment of said first pontoon, and said second pontoon to the all terrain vehicle;

means for raising and lowering said flotation means with respect to the all terrain vehicle located on said flotation means;

second attachment means connected to said second pontoon;

third attachment means connected to said first pontoon;

said second attachment means and said third attachment means connectable to foot rests on the all terrain vehicle;

and means for propelling said flotation means and the all terrain vehicle in water, said means for propelling said flotation means forming frictional engagement with the drive mechanism of the all terrain vehicle, said means for propelling including paddle wheels for attachment to the drive mechaism of the all terrain vehicle located on said flotation means.

2. The invention of claim 1 wherein said second attachment means includes a detachable link for attachment to the foot rest on the all terrain vehicle, said detachable link having a first end and a second end, said first end having a pivotal connection for attachment to a pontoon, said second end having a pivotal connection for attachment to the foot rest on the all terrain vehicle.

3. The invention of claim 2 wherein said flotation device includes a rudder for steering said flotation device.

4. The invention of claim 3 including a steering cable connected to said rudder and to the steering mechanism on the all terrain vehicle so that turning the steering mechanism on the all terrain vehicle turns said rudder.

5. The invention of claim 4 wherein said paddle wheels include a set of radial fins for mounting to the drive mechanisms of the all terrain vehicle.

6. The invention of claim 5 wherein said pontoons have a front end and a back end with both ends being beveled at an angle to facilitate ingress and egress of the flotation device and the all terrain vehicle from the water.

7. A paddle wheel for attachment to an all terrain vehicle to provide for water propulsion comprising a first member having a plurality of water engaging vanes;

a second member having a plurality of water engaging vanes connected to said first member, said first member pivotally connected to said second member; and means for producing a force to pivot said first member and said second member outward to hold said first member and said second member so that when said paddle wheel is mounted to the all terrain vehicle the frictional forces hold said paddle wheel to the drive mechanism of the all terrain vehicle.

8. The invention of claim 7 wherein said paddle wheel includes a plurality of protrusions for engagement of a recess in a rim of the all terrain vehicle tire.

9. The invention of claim 8 wherein said paddle wheel includes radially spaced vanes.

* * * * *